US010021925B1

(12) United States Patent
Lion

(10) Patent No.: US 10,021,925 B1
(45) Date of Patent: Jul. 17, 2018

(54) GLOVE WITH LIGHT

(71) Applicant: MASTRAD, S.A., Paris (FR)

(72) Inventor: Mathieu Lion, Paris (FR)

(73) Assignee: MASTRAD, S.A., Paris (FR)

( * ) Notice: Subject to any disclaimer, the term of this patent is extended or adjusted under 35 U.S.C. 154(b) by 0 days.

(21) Appl. No.: 15/591,927

(22) Filed: May 10, 2017

(51) Int. Cl.

| | |
|---|---|
| ***F21V 33/00*** | (2006.01) |
| ***A41D 19/015*** | (2006.01) |
| ***A41D 19/00*** | (2006.01) |
| ***A41D 19/01*** | (2006.01) |
| ***F21V 23/04*** | (2006.01) |
| ***F21V 31/00*** | (2006.01) |
| *F21Y 115/10* | (2016.01) |

(52) U.S. Cl.
CPC ..... *A41D 19/0157* (2013.01); *A41D 19/0037* (2013.01); *A41D 19/01* (2013.01); *A41D 19/01529* (2013.01); *F21V 23/04* (2013.01); *F21V 31/005* (2013.01); *F21V 33/0008* (2013.01); *F21Y 2115/10* (2016.08)

(58) Field of Classification Search
CPC ..... A41D 19/0055–19/0096; A41D 19/0037; A41D 19/01; A41D 19/01529; A41D 19/002–19/0041; A41D 13/08–13/088; A41D 13/0012; F21V 33/0008
See application file for complete search history.

(56) References Cited

U.S. PATENT DOCUMENTS

| | | | | |
|---|---|---|---|---|
| 3,638,011 | A * | 1/1972 | Bain | A41D 19/0157 2/160 |
| 4,625,339 | A | 12/1986 | Peters | |
| 5,816,676 | A * | 10/1998 | Koenen Myers | A61B 42/10 362/103 |
| 6,592,235 | B1 | 7/2003 | Mayo | |
| 6,892,397 | B2 * | 5/2005 | Raz | A41D 19/0157 362/103 |
| 7,152,248 | B2 | 12/2006 | Ziemer | |
| 7,520,629 | B2 | 4/2009 | Johnson et al. | |
| 8,038,310 | B1 * | 10/2011 | Hale | A41D 19/0157 362/103 |
| 8,230,522 | B1 | 7/2012 | Bell | |
| 8,562,165 | B2 * | 10/2013 | Thompson | A41D 19/0157 362/103 |

(Continued)

FOREIGN PATENT DOCUMENTS

| | | | |
|---|---|---|---|
| CN | 201753837 | U | 3/2011 |
| CN | 103005751 | A | 4/2013 |

(Continued)

*Primary Examiner* — Mariceli Santiago
(74) *Attorney, Agent, or Firm* — Karish & Bjorgum, PC

(57) ABSTRACT

A thermally and/or electrically insulative glove includes an outer back surface of molded silicone. A retainer is integrally molded with the glove body on the outer back surface to define a retainer cavity between the retainer and the outer back surface. The retainer cavity has a light opening and an access opening and is sealed by the outer back surface from the interior of the glove. A self-contained lamp is positionable in the retainer cavity through the light opening. an ON/OFF pushbutton switch is provided on the body of the self-contained lamp. The retainer includes a flexible wall with a protrusion, the protrusion being aligned with the on/off pushbutton switch with the lamp fully positioned in the retainer cavity.

13 Claims, 4 Drawing Sheets

(56) References Cited

U.S. PATENT DOCUMENTS

| | | | | |
|---|---|---|---|---|
| 2002/0078490 | A1* | 6/2002 | Bignon | A41D 19/0003 2/161.6 |
| 2006/0092624 | A1 | 5/2006 | Park | |
| 2006/0225184 | A1* | 10/2006 | Ziemer | A41D 19/0157 2/160 |
| 2007/0058362 | A1 | 3/2007 | Winfrey | |
| 2009/0168407 | A1* | 7/2009 | Wright | F21V 21/0965 362/103 |
| 2009/0323316 | A1* | 12/2009 | Matheney, II | A41D 19/0157 362/103 |
| 2013/0087544 | A1* | 4/2013 | Kremer | H05B 3/00 219/211 |
| 2014/0265906 | A1* | 9/2014 | Lim | H05B 33/0815 362/103 |
| 2015/0366228 | A1 | 12/2015 | Lugo | |

FOREIGN PATENT DOCUMENTS

| | | | |
|---|---|---|---|
| CN | 103133878 | | 6/2013 |
| CN | 103133878 | A | 6/2013 |
| CN | 203087612 | U | 7/2013 |
| CN | 203182081 | U | 9/2013 |
| CN | 103727408 | A | 4/2014 |
| CN | 103727408 | A1 | 4/2014 |
| CN | 104000321 | | 8/2014 |
| CN | 104000321 | A | 8/2014 |
| CN | 104000323 | | 8/2014 |
| CN | 104000323 | A | 8/2014 |
| KR | 10-1449727 | | 10/2014 |
| WO | WO2009/142965 | A2 | 11/2009 |
| WO | WO2009/142965 | A3 | 11/2009 |

* cited by examiner

GLOVE WITH LIGHT

BACKGROUND OF THE INVENTION

The field of the present invention is lighted gloves.

In the kitchen, barbecue and do-it-yourself home environments, circumstances can exist where areas, such as the interior of an oven, can be both dangerous and dark. In an oven, the oven itself and heated objects therein may present the possibility of burns. If dark, this possibility can be amplified. Lighted gloves are known; however, they are typically not suitable for the domestic environment.

SUMMARY OF THE INVENTION

The present invention is directed to a lighted glove. The glove includes a glove body which has at least an outer back surface of molded silicone. A retainer is integrally mounted with the glove body on the outer back surface. The retainer includes a retainer cavity which is sealed from the interior of the glove. A self-contained lamp is positionable in the retainer cavity through a light opening. The retainer includes a flexible wall with a protrusion, the protrusion being aligned with an ON/OFF pushbutton switch associated with the lamp. These features provide for an insulative area around the lamp from heat, steam and/or electrical shock, for access to the lamp and for sealing of the glove cavity from the retainer cavity.

Additional features contemplated include mechanisms for lamp removal and a greater inclusion of silicone for the glove. For removal, an access opening diametrically opposed to the light opening for forcing the self-containing lamp from the retainer cavity and/or a handle on the self-contained lamp extending from the light opening to assist in removal may be employed. A waterproof capsule for the lamp and an appropriate location for the lamp on the glove are also contemplated.

Accordingly, it is a principal object of the present invention to provide an improved glove for use where light is needed as well as protection. Other and further aspects and advantages will appear hereinafter. The variations in features among embodiments are understood to be interchangeable among the embodiments.

DETAILED DESCRIPTION OF THE PREFERRED EMBODIMENT

Figure 1:
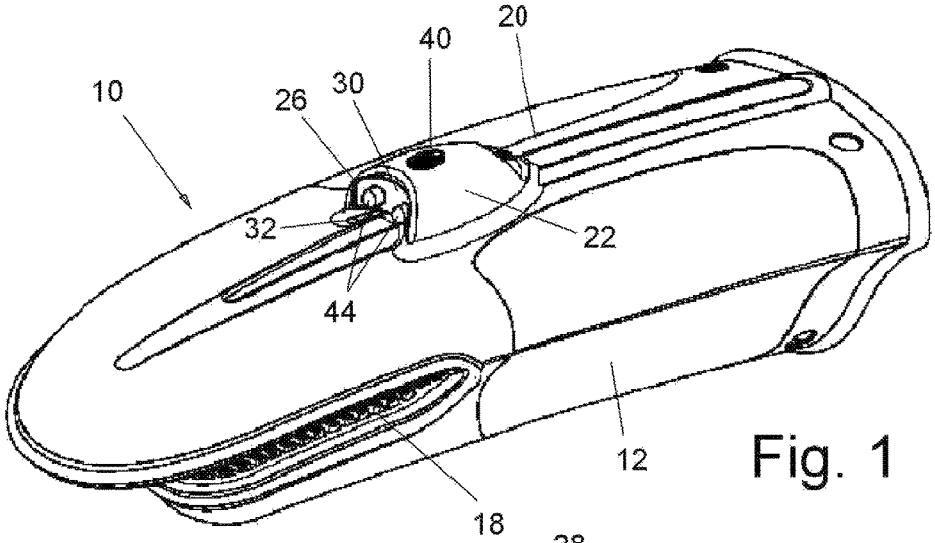
FIG. 1 is an isometric view of a glove.
Figure 2:
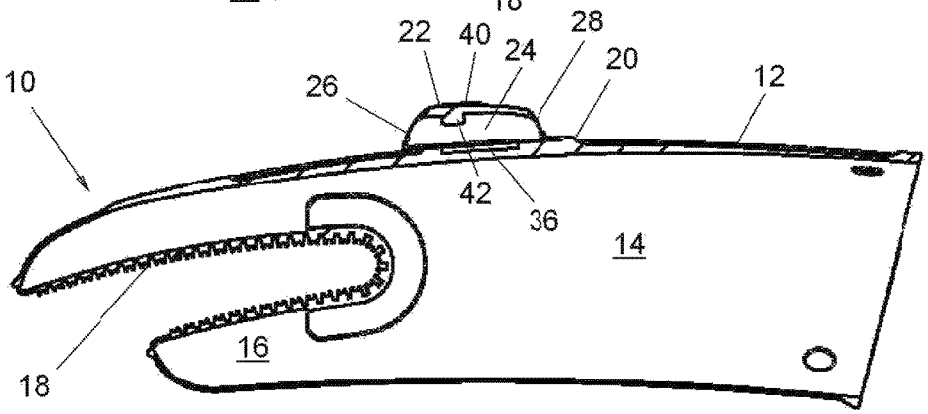
FIG. 2 is a vertical cross-sectional view taken centrally through the glove body.
Figure 3:
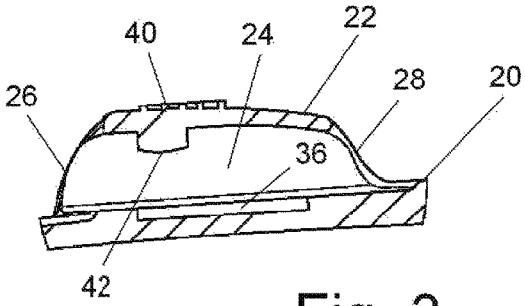
FIG. 3 is a cross-sectional detail view of the retainer as seen in FIG. 2.
Figure 4:
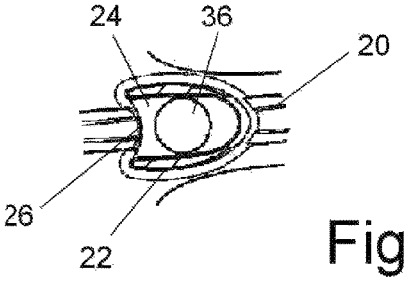
FIG. 4 is a cross-sectional detail plan view taken through the center of the retainer cavity parallel to the surface of the glove.
Figure 5:
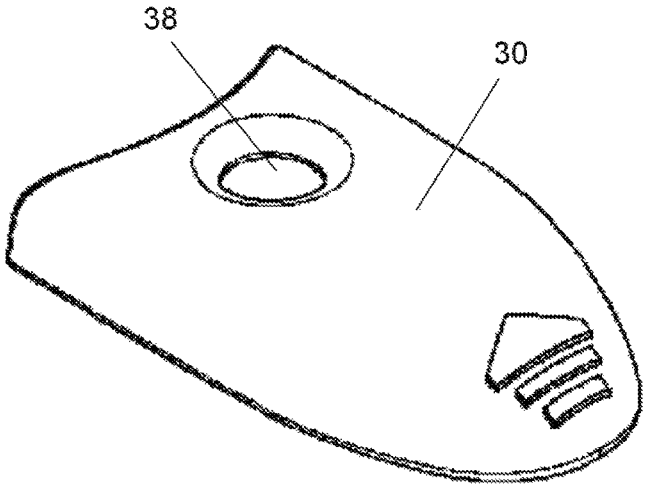
FIG. 5 is an isometric view of a commercially available lamp.
Figure 6:
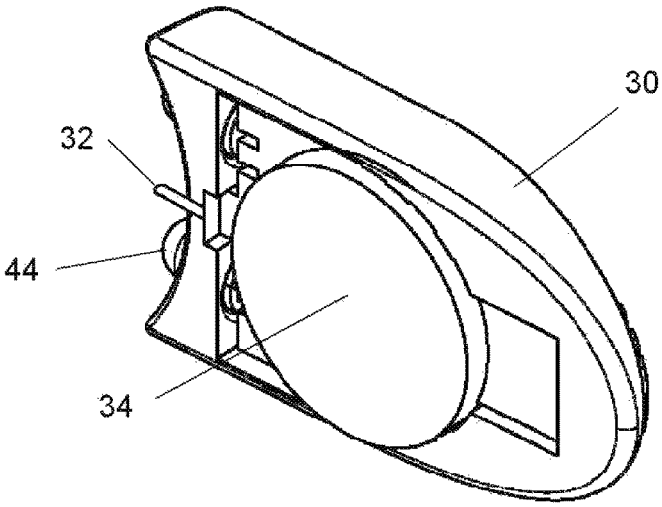
FIG. 6 is an isometric view of the bottom of the lamp of FIG. 4.
Figure 7:
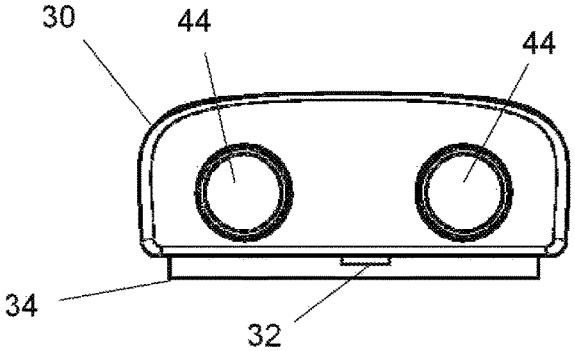
FIG. 7 is a front view of the lamp of FIG. 4.
Figure 8:
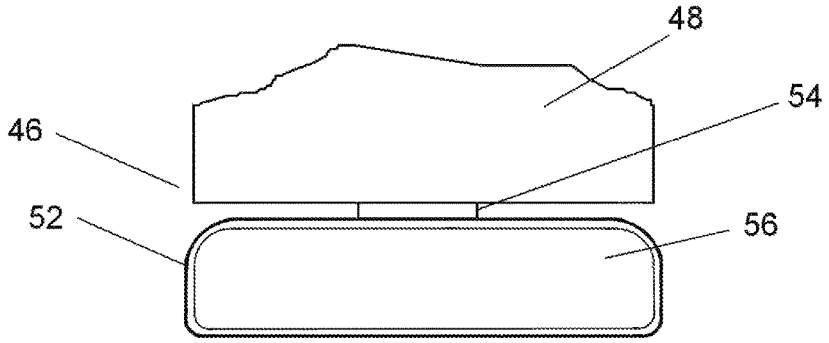
FIG. 8 is a front view of a re-enterable outer waterproof capsule.
Figure 9:
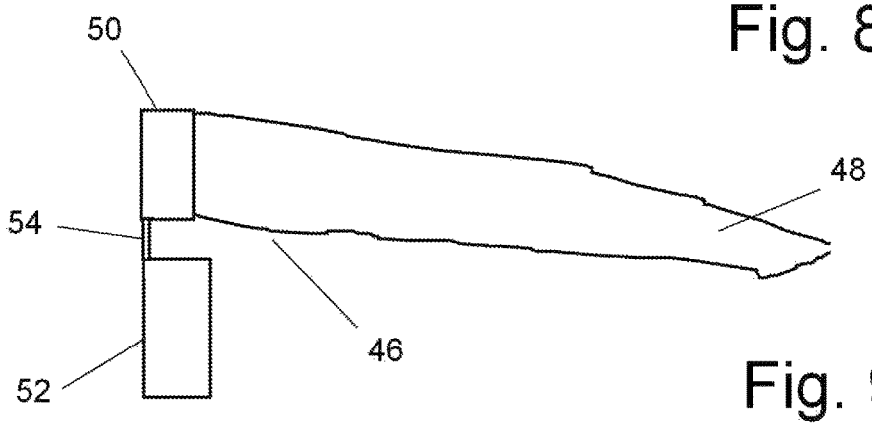
FIG. 9 is a side view of the re-enterable outer waterproof capsule.
Figure 10:
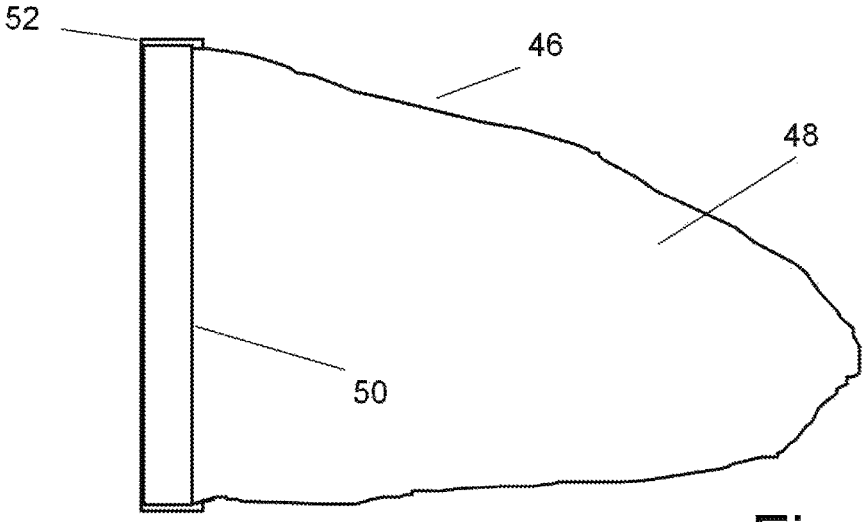
FIG. 10 is a top view of the re-enterable outer waterproof capsule.
Figure 11:
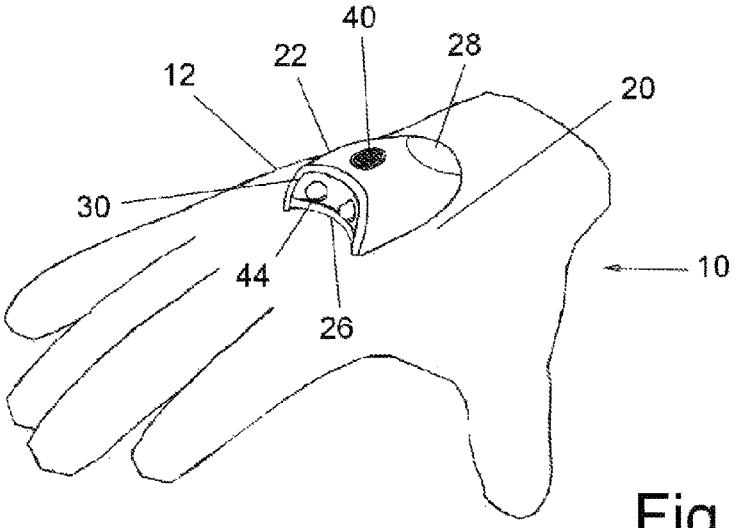
FIG. 11 is an isometric view of a second glove.

Turning in detail to the Figures, a glove, generally designated 10 includes a glove body 12 with a hand cavity 14 and a thumb cavity 16. The thumb cavity is open to the hand cavity. The glove 10 can be of many designs. A preferred embodiment is shown to be a fingerless mitt in FIGS. 1 through 10. Another preferred design amends the glove body 12 and, therefore, the hand cavity 14 as well, to provide glove fingers shown in FIGS. 11 through 13. The glove body 12 further includes a gripping outer surface 18 located between the hand cavity 14 and the thumb cavity 16 on the exterior of the glove body 12.

Figure 12:
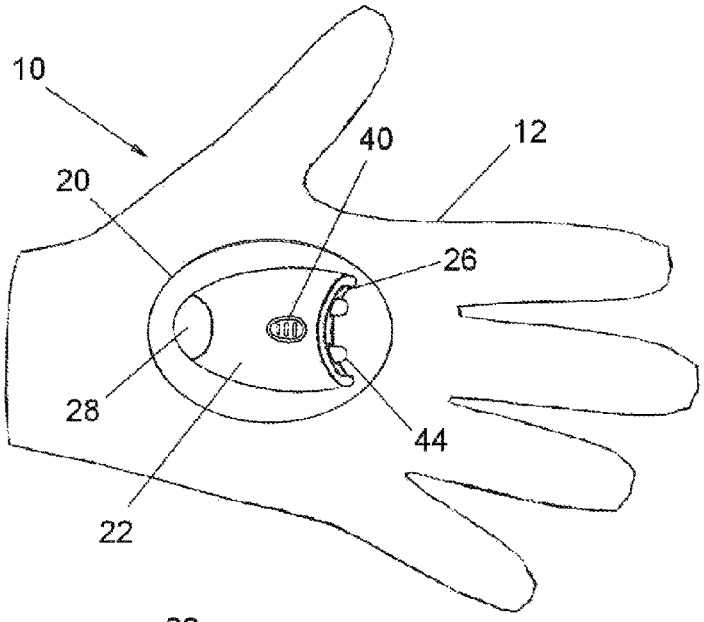
FIG. 12 is a plan view of the glove of FIG. 11.
Figure 13:
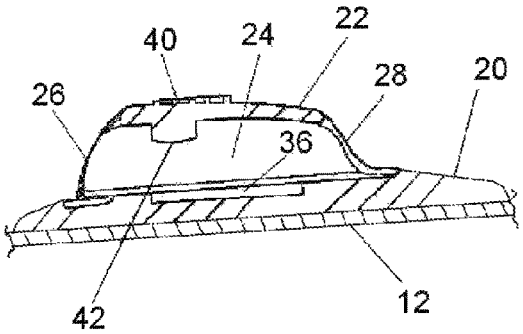
FIG. 13 is a vertical cross-sectional detail view of the retainer of FIG. 12.

In the mitt embodiment, the entire glove body 12 is shown to be integrally molded silicone. Other, more traditional glove materials may be incorporated into the glove body such as fabric and leather, including the back of the glove as seen in the fingered glove embodiment. Strategic areas of the glove, such as the gripping outer surface 18 are preferably of thermally and/or electrically insulative material. Even so, an outer back surface 20 defining part of or at least coating an area on the outside of the glove body 12 is specifically of insulative molded silicone. The back of the fingered glove is shown to have the insulative molded silicone outer back surface 20 be only a portion of the back of the glove body 12 as seen in FIGS. 12 and 13.

The outer back surface 20 includes a retainer 22. The retainer 22 is integrally molded with the outer back surface 20 and, in the embodiment of FIGS. 1 through 10, with the entire glove body 12. The retainer 22 defines a retainer cavity 24 between the arc of the retainer 22 and the outer back surface 20. The outer back surface 20 is sealed beneath the retainer 22 to retain the integrity of the hand cavity 14. A light opening 26 to the retainer cavity 24 provides an opening for access to the retainer cavity 24 from the forward end of the retainer 22. An access opening 28 to the retainer cavity 24 is diametrically opposed to the light opening 26. The retainer 22 is centrally located on the outer back surface 20 of the glove body 12 as can best be seen in the Figures.

A conventional self-contained lamp 30 is sized to fit snugly within the retainer cavity 24. The lamp 30 is positionable and extractable through the light opening 26. The lamp 30 may have an unobtrusive handle 32 to assist in placing and extracting the lamp 30. Alternatively, the access opening 28 illustrated in the preferred embodiment will allow access to the back of the lamp 30 for pushing it forwardly through the light opening 26.

The fit of the self-contained lamp 30 in the retainer cavity 24 preferably prevents the lamp 30 from being extracted through the access opening 28. As such, the entire retainer cavity provides a seat for accurate placement of the lamp 30 when inserted through the light opening 26. Further, the lamp 30 includes a short cylindrical mount 34 on the bottom of the body of the lamp 30. A matching cavity 36 on the molded outer back surface 20 is able to receive the cylindrical mount 34. The cavity 36 provides a positive retention of the lamp 30, which retention can be overcome because of the resilience of the silicone for removal of the lamp 30.

The top of the lamp 30 includes a recessed ON/OFF pushbutton switch 38. The upper wall of the retainer 22 defines a flexible wall which is aligned with the ON/OFF pushbutton switch 38 when the self-contained lamp 30 is positioned in the retainer cavity 24. On the underside of the flexible wall 40, a protrusion 42 is directly aligned with the ON/OFF pushbutton switch 38 such that depression of the top of the retainer 22 allows actuation of the ON/OFF pushbutton switch 38.

The lamp 30 conventionally includes a simple circuit with a battery (not shown). Two light-emitting diodes 44 are powered by the battery and controlled by the ON/OFF pushbutton switch 38. The LEDs 44 are forwardly positioned on the lamp 30 to be aligned with the light opening 26 when the lamp 30 is positioned fully in the retainer cavity 24.

The self-contained lamp 30 is preferably dishwasher safe with a barrier to moisture. This may be accomplished by elaborate sealing arrangements around the light-emitting diodes 44 and across the underside of the open cover. Sealing may also be provided by eliminating the access opening 28 and providing a clear plug to seal the light opening 26. Alternatively, a re-enterable outer waterproof capsule 46 is contemplated which will seal the main body of the lamp. Silicone is again contemplated for this capsule 46.

The body 48 of the capsule 46 may be of thin, flexible waterproof material to slip easily over the self-contained lamp 30 with a collar 50 about an opening in the front of the body 48. The collar is of comparatively rigid but resilient material. A cap 52 may be associated with the collar 50 by a living hinge 54. The cap 52 closes the collar 50 to provide a watertight seal. A pane 56 of deep, clear silicone in the cap 52 provides for transmission of the illumination from the light-emitting diodes 44. The profile of the collar 50 and the engaging cap 52 are preferably rounded to snugly fit in the light opening 26. The retainer cavity 24 may be extended to accommodate the collar 50 and cap 52 in front of the self-contained lamp 30. The clear pane 56 is located at the front of the cap 52 to provide room for the LEDs 44.

Thus, an improved glove has been disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A glove comprising a glove body including a hand cavity, a thumb cavity, and an outer back surface, the outer back surface being made of molded silicone:

a gripping outer surface between the thumb cavity and the hand cavity;

a retainer integrally molded with the glove body on the outer back surface and including a retainer cavity between the retainer and the outer back surface, the retainer cavity having a light opening, the hand cavity and the thumb cavity being sealed from the retainer cavity by the outer back surface;

a self-contained lamp positionable in the retainer cavity through the light opening, the lamp including an on/off pushbutton switch, the retainer including a flexible wall with a protrusion, the protrusion being aligned with the on/off pushbutton switch with the lamp fully positioned in the cavity.

2. The glove of claim 1, the lamp including a front handle through the light opening with the lamp positioned in the retainer cavity.

3. The glove of claim 1, the retainer cavity further having an access opening diametrically opposed to the light opening, the self-contained lamp not being positionable in the retainer cavity through the access.

4. The glove of claim 3, the lamp including a front handle through the light opening with the lamp positioned in the retainer cavity for positioning the lamp.

5. The glove of claim 1, the self-contained lamp being dishwasher safe.

6. The glove of claim 5, the self-contained lamp including a re-enterable outer waterproof capsule.

7. The glove of claim 1, the lamp including at least one light emitting diode.

8. The glove of claim 1, the retainer being centrally located on the outer back surface.

9. The glove of claim 1, the glove body being integrally molded silicone with the outer back surface.

10. A glove comprising a glove body including an outer back surface area of molded silicone:

a retainer integrally molded with the outer back surface area and including a retainer cavity, the retainer cavity having a light opening;

a self-contained lamp positionable in the retainer cavity through the light opening, the lamp including an on/off pushbutton switch, the retainer including a flexible wall with a protrusion, the protrusion being aligned with the on/off pushbutton switch with the lamp fully positioned in the cavity;

a barrier to moisture fully sealing the self-contained lamp.

11. The glove of claim 10, the barrier to moisture including a waterproof re-enterable capsule having a body enclosing the self-contained lamp and a cap engaging the body and with a clear pane at the light opening.

12. The glove of claim 10, the lamp including at least one light emitting diode.

13. The glove of claim 10, the glove body being integrally molded silicone with the outer back surface.

* * * * *